US008833759B2

(12) United States Patent
Fan Chiang et al.

(10) Patent No.: US 8,833,759 B2
(45) Date of Patent: Sep. 16, 2014

(54) PRINTER WITH RE-POSITIONABLE PAPER OUTPUT TRAY

(71) Applicant: Hon Hai Precision Industry Co., Ltd., New Taipei (TW)

(72) Inventors: Kai Fan Chiang, New Taipei (TW); Shu-Kai Lu, New Taipei (TW); Chin-Ta Ma, New Taipei (TW)

(73) Assignee: Hon Hai Precision Industry Co., Ltd., New Taipei (TW), `

( * ) Notice: Subject to any disclaimer, the term of this patent is extended or adjusted under 35 U.S.C. 154(b) by 21 days.

(21) Appl. No.: 13/862,645

(22) Filed: Apr. 15, 2013

(65) Prior Publication Data

US 2013/0341855 A1 Dec. 26, 2013

(30) Foreign Application Priority Data

Jun. 20, 2012 (TW) ..... 101121975 A

(51) Int. Cl.
*B65H 31/04* (2006.01)
*B65H 31/00* (2006.01)

(52) U.S. Cl.
CPC ..... *B65H 31/00* (2013.01)
USPC ..... 271/213; 271/207

(58) Field of Classification Search
USPC ..... 271/213, 207
See application file for complete search history.

(56) References Cited

U.S. PATENT DOCUMENTS

| | | | | | |
|---|---|---|---|---|---|
| 5,061,098 | A * | 10/1991 | Engelhardt et al. | ..... | 400/625 |
| 5,897,113 | A * | 4/1999 | Kondo et al. | ..... | 271/213 |
| 6,027,114 | A * | 2/2000 | Watanabe et al. | ..... | 271/265.01 |
| 6,428,000 | B1 * | 8/2002 | Hara et al. | ..... | 271/223 |
| 6,595,514 | B2 * | 7/2003 | Takahashi | ..... | 271/162 |
| 7,073,787 | B2 * | 7/2006 | Kinsley et al. | ..... | 271/162 |
| 7,306,217 | B2 * | 12/2007 | Bandou et al. | ..... | 271/145 |
| 7,520,502 | B2 * | 4/2009 | Maeda | ..... | 271/162 |
| 7,553,099 | B2 * | 6/2009 | Bandou et al. | ..... | 400/624 |
| 7,614,739 | B2 * | 11/2009 | Anami et al. | ..... | 347/104 |
| 7,926,804 | B2 * | 4/2011 | Chinzei et al. | ..... | 271/162 |
| 8,469,352 | B2 * | 6/2013 | Kunioka | ..... | 271/3.14 |
| 8,573,584 | B2 * | 11/2013 | Idehara et al. | ..... | 271/3.14 |
| 2011/0285077 | A1 * | 11/2011 | Otani et al. | ..... | 271/213 |

* cited by examiner

*Primary Examiner* — Kaitlin Joerger
(74) *Attorney, Agent, or Firm* — Novak Druce Connolly Bove + Quigg LLP

(57) ABSTRACT

A printer includes an enclosure, a paper output tray, and two positioning devices. The enclosure includes a receiving base and two side portions extending from the receiving base. The paper output tray is pivotally mounted between the two side portions. The two positioning devices are mounted to the two side portions. The paper output tray is placed in the receiving base in a first position. The paper output tray can rotate to resist each of the two positioning devices and move to a side portion, thereby enabling the paper output tray to rotate to a second position. Each of the two positioning devices restores to an original position to support the paper output tray stably in the second position, to enable the removal of a paper jam or other circumstance.

18 Claims, 7 Drawing Sheets

PRINTER WITH RE-POSITIONABLE PAPER OUTPUT TRAY

BACKGROUND

1. Technical Field

The present disclosure relates to printers, more particularly to a printer with a re-positionable paper output tray.

2. Description of Related Art

A paper output tray of a printer is often secured on the paper input tray. However, the paper output tray needs to be disassembled from the printer to check the paper input tray when the printer is blocked by paper, which is inconvenient.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
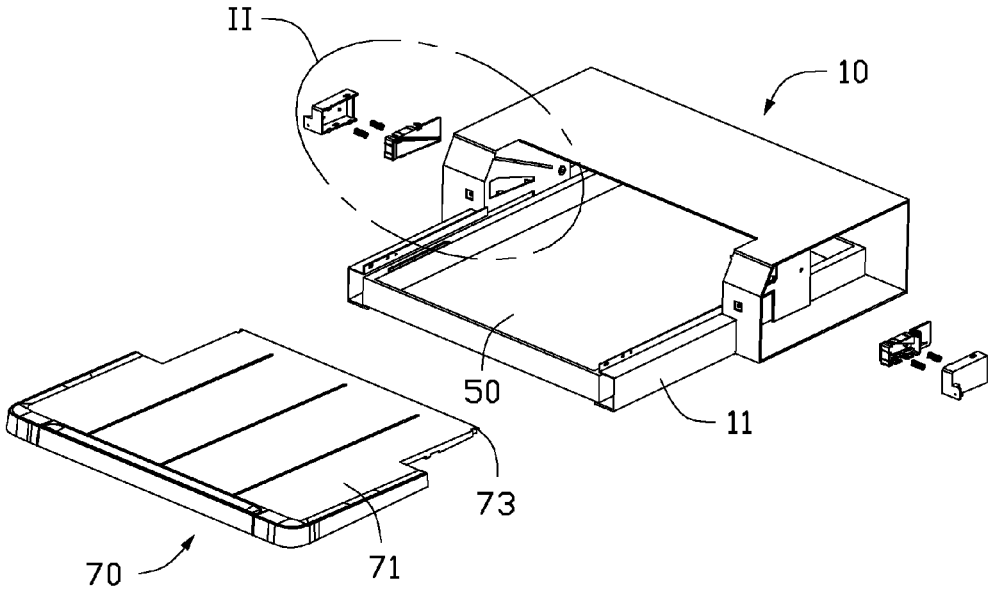
FIG. 1 is an exploded, isometric view of a printer with a re-positionable paper output tray in accordance with one embodiment of the present disclosure.
Figure 2:
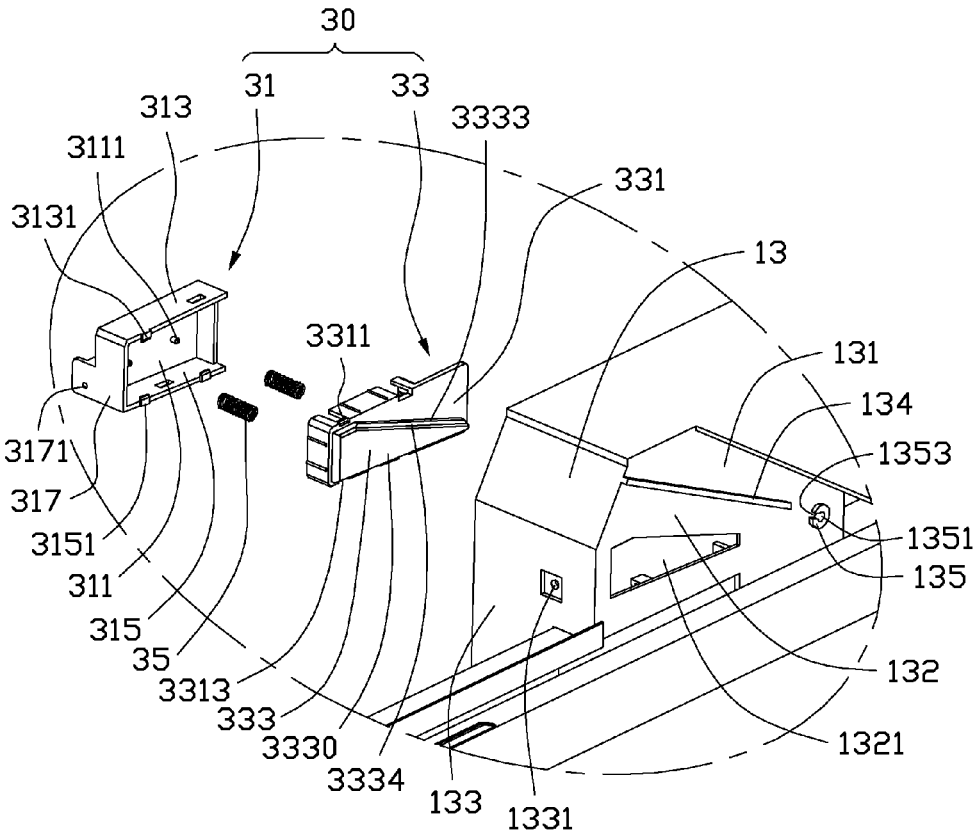
FIG. 2 is a partial and enlarged view of FIG. 1.

FIGS. 1 and 2 show a printer in accordance with one embodiment. The printer includes an enclosure 10, two positioning devices 30, a paper input tray 50, and a paper output tray 70.

The enclosure 10 includes a receiving base 11 and two side portions 13 extending from the receiving base 11. Each side portion 13 includes a side wall 131 and a front wall 133, extending from the side wall 131. The side wall 131 includes a side wall body 132, an elongated guiding portion 134 extending from the side wall body 132, and a pivot protrusion 135 extending from the side wall body 132. The side wall body 132 defines a mounting opening 1321. The mounting opening 1321 is triangular. The pivot protrusion 135 defines a pivot hole 1351 and a cutout 1353, communicating with the pivot hole 1351. The front wall 133 defines a mounting hole 1331. The extending direction of the elongated guiding portion 134 corresponds to the cutout 1353.

Figure 3:
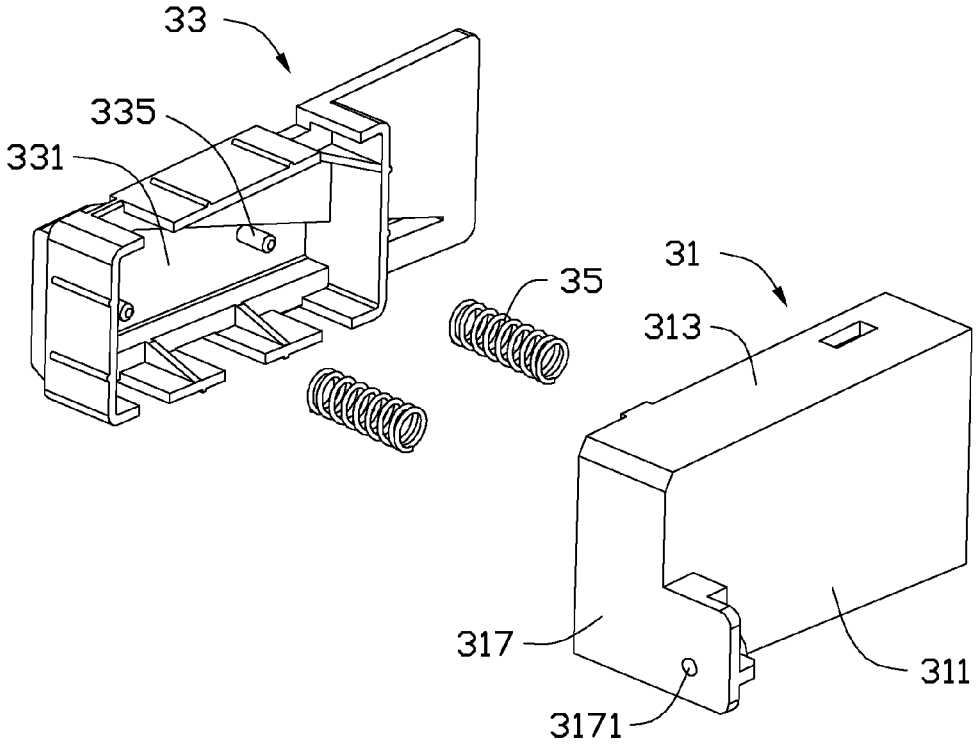
FIG. 3 is an exploded, isometric view of the positioning device of FIG. 1.

Referring to FIGS. 2 and 3, each positioning device 30 includes a positioning bracket 31 and a positioning member 33. The positioning bracket 31 includes a base panel 311, a first securing panel 313, a second securing panel 315, and a side panel 317 perpendicularly extending from the base panel 311. The first securing panel 313 and the second securing panel 315 perpendicularly extend from opposite sides of the base panel 311. The positioning bracket 31 further includes two first positioning protrusions 3111 extending from the base panel 311. The positioning bracket 31 further includes a first engaging portion 3131, extending inward from the first securing panel 313, and two second engaging portions 3151, extending inward from the second securing panel 315. The side panel 317 defines a securing hole 3171 corresponding to the mounting hole 1331.

The positioning member 33 includes a positioning panel 331, a positioning portion 333 protruding outward from the positioning panel 331, and two second positioning protrusions 335 extending inward from the positioning panel 331. The positioning portion 333 is triangular. The positioning portion 333 includes a positioning surface 3330 substantially parallel to the positioning panel 331. The positioning portion 333 further includes a lower edge 3331 and an inclining edge 3333, both extending from positioning panel 331. The lower edge 3331 is connected to the positioning surface 3330 via a first guiding surface 3332. The inclining edge 3333 is connected to the positioning surface 3330 via a second guiding surface 3334. In one embodiment, the first guiding surface 3332 and the second guiding surface 3334 are inclining surfaces. The first guiding surface 3332 and the second guiding surface 3334 are also curved surfaces. The positioning panel 331 defines a first engaging opening 3311, corresponding to the first engaging portion 3131, and two second engaging openings 3313, corresponding to the two second engaging portions 3151.

Each positioning device 30 further includes two elastic elements 35. In one embodiment, the elastic elements 35 are coil springs. The elastic element 35 is coiled between each first positioning protrusion 3111 and each second positioning protrusion 335.

The paper input tray 50 is received in the receiving base 11 of the enclosure 10. The paper output tray 70 includes a tray body 71 and two pivot portions 73 extending from the tray body 71. The two pivot portions 73 are received in the pivot holes 1351 of the enclosure 10.

Figure 4:
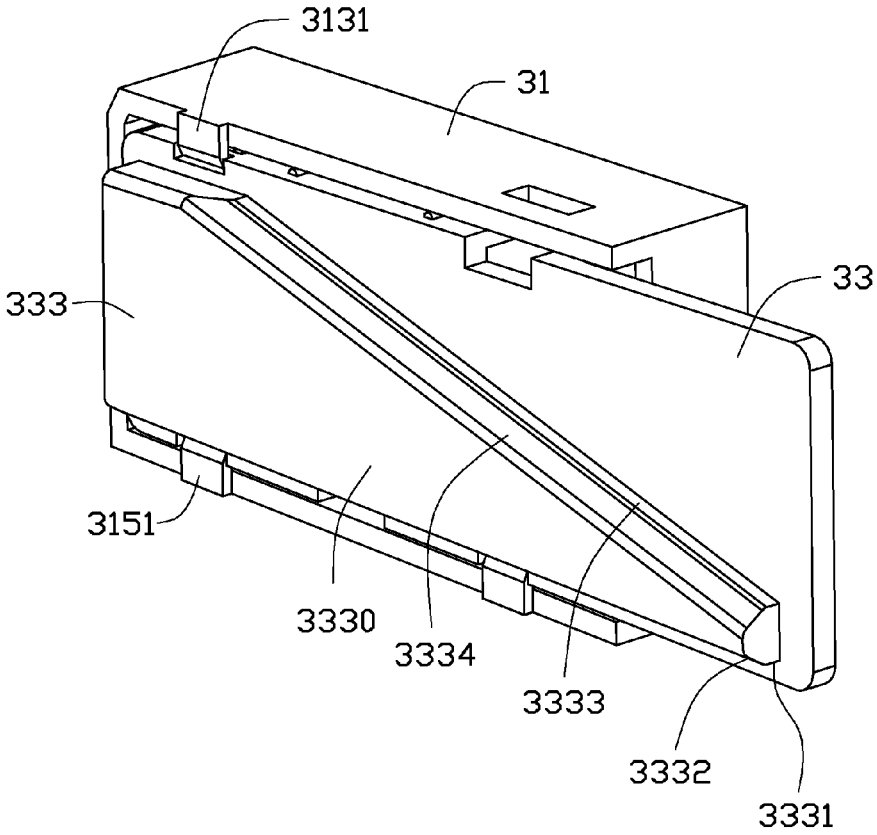
FIG. 4 is an assembled view of the positioning device of FIG. 1.

FIG. 4 shows assembly, whereby each elastic element 35 is coiled between a first positioning protrusion 3111 and a second positioning protrusion 335. The first engaging portion 3131 and the second engaging portion 3151 are aligned with the first engaging opening 3311 and the second engaging opening 3313. The positioning member 33 moves towards the positioning bracket 31. The first engaging portion 3131 and the second engaging portion 3151 resist the positioning member 33 and are extended outwards. The positioning bracket 31 keeps moving. The first engaging portion 3131 and the second engaging portion 3151 release to engage the first engaging opening 3311 and the second engaging opening 3313, when the first engaging 3311 and the second engaging opening 3313 are aligned with the first engaging portion 3131 and the second engaging portion 3151. At this time, the elastic elements 35 create resistance between the positioning bracket 31 and the positioning members 33. The two positioning devices 30 are placed to the inner side of the side wall 131 of the enclosure 10 to enable the positioning portion 333 to be received in the mounting opening 1321. The securing hole 3171 of each positioning device 30 is aligned with the mounting hole 1331 of the enclosure 10. Two fasteners (not shown) are screwed into the securing holes 3171 and the mounting holes 1331, thereby securing the positioning devices 30 to the enclosure 10.

Figure 5:
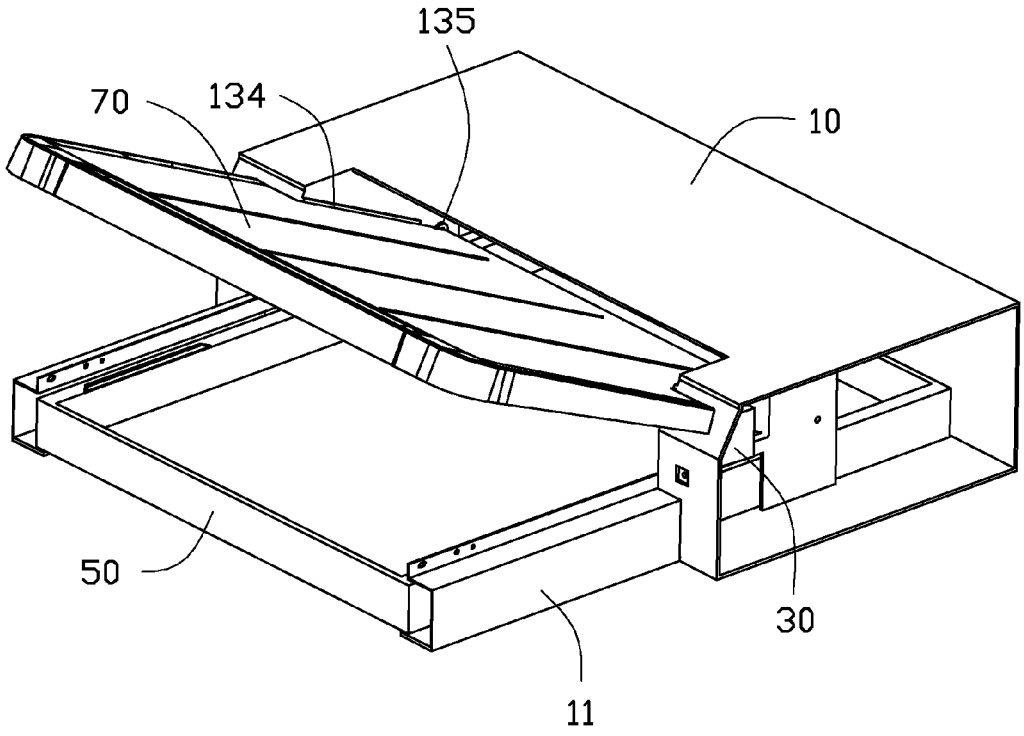
FIG. 5 is a pre-assembled view of FIG. 1.
Figure 6:
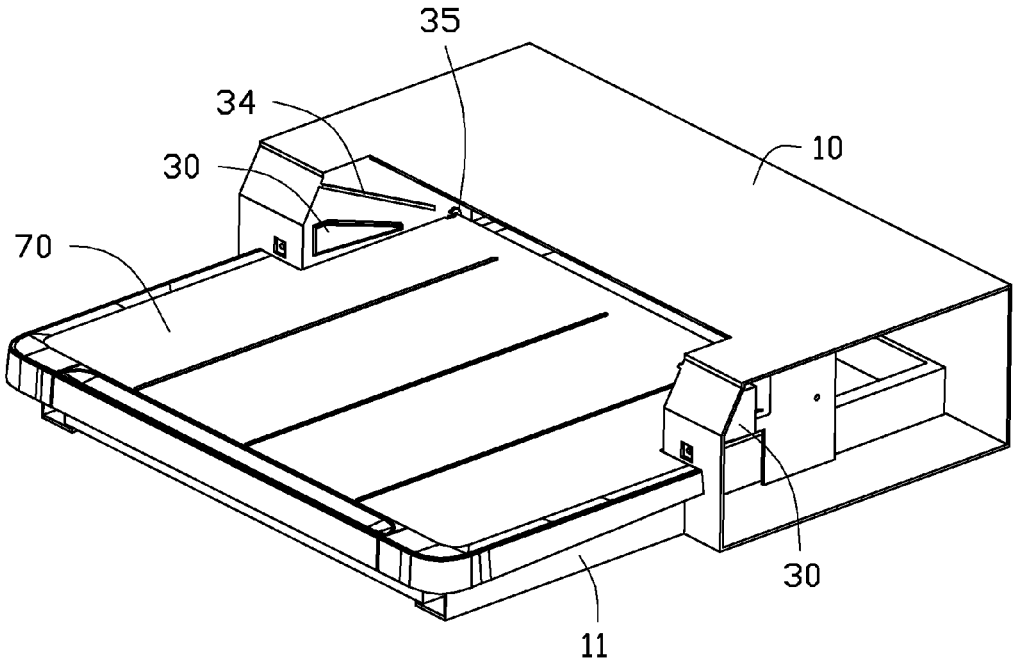
FIG. 6 is an assembled view of FIG. 1, the paper output tray in a first position.

Referring to FIGS. 5 and 6, the paper output tray 70 moves along the guiding portions 134 to enable the pivot portions 73 to move into the pivot holes 1351 via the cutouts 1353. The paper out tray 70 rotates downward and resists the second guiding surfaces 3334 of the positioning devices 30, to enable the positioning member 33 to move to the positioning bracket 31. At this time, the elastic elements 35 are compressed. The paper output tray 70 continues to rotate to enable the paper output tray 70 to be in a horizontal position. At this time, the paper output tray 70 is substantially parallel to the paper input tray 50. The elastic elements 35 restore the positioning members 33 back to the original position.

Figure 7:
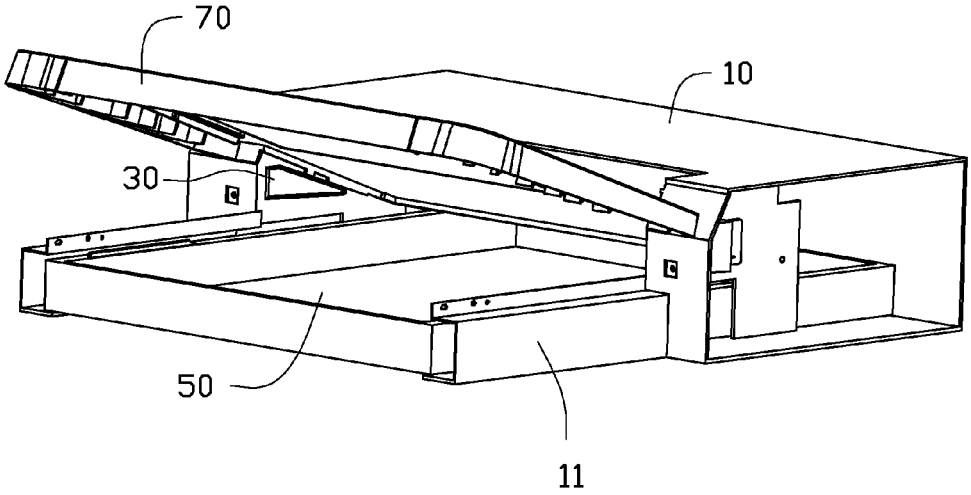
FIG. 7 is another assembled view of FIG. 1, the paper output tray in a second position.

Referring to FIG. 7, the paper output tray 70 rotates upwards and resists the first guiding surfaces 3332 of the positioning devices 30 to enable the positioning members 33 to move to the positioning brackets 31. The positioning members 33 move back their original positions when the paper output tray 70 rotates to be aligned with the inclining edges 3333 of the positioning member 33. The paper output tray 70 can be placed on the inclining edges 3333 of the positioning devices 30.

The paper output tray 70 continues to rotate upwards until contact is made with the guiding portions 134. The paper output tray 70 is pulled outward, thereby being disassembled from the printer.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A printer, comprising:

an enclosure, the enclosure comprises a receiving base, a first side portion, and a second side portion; the first side portion and the second side portion both extend from the receiving base; and the first side portion comprises a side wall body; and the side wall body defines a mounting opening;

a paper output tray, the paper output tray is pivotally mounted between the first side portion and the second side portion; and a positioning device, the positioning device is mounted to the side wall body of the first side portion; the positioning device comprises a positioning bracket, a positioning member, and an elastic element connected between the positioning bracket and the positioning member; the positioning member comprises a positioning panel and a positioning portion protruding outward from the positioning panel; the positioning bracket, the elastic element and the positioning panel are located on an outer side of the side wall body; the positioning portion is received in the mounting opening; the elastic element is configured to be resiliently compressed when the positioning portion of the positioning member moves into the mounting opening to move to the positioning bracket;

wherein the paper output tray is placed in the receiving base in a first position; and the paper output tray is configured to rotate to resist the positioning portion, to enable the positioning portion of the positioning member to move into the mounting opening to move to the positioning bracket, and to be placed on the positioning portion in a second position, when the elastic element rebounds to drive the positioning member to get back to an original position.

2. The printer of claim 1, wherein the positioning portion comprises an inclining edge, and the paper output tray is placed on the inclining edge in the second position.

3. The printer of claim 2, wherein the positioning portion comprises a lower edge, and the paper output tray is located below the lower edge in the first position.

4. The printer of claim 3, wherein the positioning portion comprises a positioning surface; the first side portion comprises a side wall body substantially parallel to the positioning surface; the positioning surface is connected to the lower edge via a first guiding surface; and the paper output tray is configured to resist the first guiding surface to drive the positioning member to move to the positioning bracket.

5. The printer of claim 4, wherein the positioning surface is connected to the inclining edge via a second guiding surface, and the paper output tray is configured to resist the second guiding surface to enable the positioning member to move to the positioning bracket.

6. The printer of claim 1, wherein the paper output tray comprises a pivot portion; the first side portion comprises a pivot protrusion protruding from the side wall body; the pivot protrusion defines a pivot hole receiving the pivot portion.

7. The printer of claim 6, wherein the pivot protrusion defines a cutout communicating with the pivot hole, and the pivot portion is configured to extend into the pivot hole via the cutout.

8. The printer of claim 7, wherein the first side portion further comprises a guiding portion extending from the side wall body, and the paper output tray is configured to move into the cutout along the guiding portion.

9. The printer of claim 8, wherein the guiding portion is elongated, and an extending direction of the guiding portion corresponds to the cutout.

10. A printer, comprising:

an enclosure, the enclosure comprising a receiving base and two side portions extending from the receiving base; each of the two side portions comprises a side wall body; and the side wall body defines a mounting opening;

a paper output tray, the paper output tray is pivotally mounted between the two side portions; and two positioning devices, each of the two positioning devices is mounted to a side portion;

wherein the paper output tray is placed in the receiving base in a first position; the paper output tray is configured to rotate to resist each of the two positioning devices to move to the corresponding side portion, thereby enabling the paper output tray to rotate to a second position; and each of the two positioning devices is configured to get back to support the paper output tray in the second position; each of the two positioning devices comprises a positioning bracket, a positioning member, and an elastic element connected between the positioning bracket and the positioning member; the positioning member comprises a positioning panel and a positioning portion protruding outward from the positioning panel; the positioning bracket, the elastic element and the positioning panel are located on an outer side of the side wall body; the positioning portion is received in the mounting opening; the paper output tray is configured to rotate to resist the two positioning portions to enable the two positioning portions of the two positioning members to move into corresponding mounting openings to move to the corresponding positioning brackets; and the elastic element is configured to rebound to drive the positioning member to get back to support the paper output tray in the second position.

11. The printer of claim 10, wherein the positioning portion comprises an inclining edge, and the paper output tray is placed on the inclining edge in the second position.

12. The printer of claim 11, wherein the positioning portion comprises a lower edge, and the paper output tray is located below the lower edge in the first position.

13. The printer of claim 12, wherein the positioning portion comprises a positioning surface; the first side portion comprises a side wall body substantially parallel to the positioning surface; the positioning surface is connected to the lower edge via a first guiding surface; and the paper output tray is configured to resist the first guiding surface to drive the positioning member to move to the positioning bracket.

14. The printer of claim 13, wherein the positioning surface is connected to the inclining edge via a second guiding surface, and the paper output tray is configured to resist the second guiding surface to enable the positioning member to move to the positioning bracket.

15. The printer of claim 10, wherein the first side portion comprises a first side wall body, and the side wall body defines a mounting opening receiving the positioning portion.

16. The printer of claim 10, wherein the paper output tray comprises a pivot portion; the first side portion comprises a side wall body and a pivot protrusion protruding from the side wall body; the pivot protrusion defines a pivot hole receiving the pivot portion.

17. The printer of claim 16, wherein the pivot protrusion defines a cutout communicating with the pivot hole, and the pivot portion is configured to extend into the pivot hole via the cutout.

18. The printer of claim 17, wherein the first side portion further comprises a guiding portion extending from side wall body, and the paper output tray is configured to move into the cutout along the guiding portion.

* * * * *